US005528253A

United States Patent [19]

Franklin

[11] Patent Number: 5,528,253

[45] Date of Patent: Jun. 18, 1996

[54] SATELLITE DISH UTILITY COVER

[75] Inventor: Sharon E. Franklin, Ozark, Ak.

[73] Assignee: Paul Dean Franklin, Ozark, Ak.

[21] Appl. No.: 466,292

[22] Filed: Jun. 6, 1995

Related U.S. Application Data

[63] Continuation-in-part of Ser. No. 241,507, May 12, 1994, Pat. No. 5,451,972.

[51] Int. Cl.[6] ..... H01Q 19/12

[52] U.S. Cl. ..... 343/840; 343/872

[58] Field of Search ..... 343/840, 872; 383/74, 75, 4; 52/149, 222; 150/154; 254/222, 223

[56] References Cited

U.S. PATENT DOCUMENTS

| | | | |
|---|---|---|---|
| D. 304,454 | 11/1989 | Serres | D14/231 |
| 810,795 | 1/1906 | Mcpherson | 254/223 |
| 2,366,299 | 1/1945 | Benschoten | 242/395 |
| 3,351,947 | 11/1967 | Hart | 343/840 |
| 3,388,401 | 6/1968 | Weir | 343/872 |
| 3,599,218 | 8/1971 | Williamson et al. | 343/812 |
| 3,740,755 | 6/1973 | Grenzeback | 343/840 |
| 4,142,190 | 2/1979 | Kerr | 343/840 X |
| 4,260,003 | 4/1981 | Hendrickson | 383/72 |
| 4,275,859 | 6/1981 | Bleday | 343/872 X |
| 4,293,862 | 10/1981 | Beavers | 343/872 |
| 4,804,972 | 4/1989 | Schudel | 343/840 |
| 5,207,508 | 5/1993 | Koutsis | 383/74 X |
| 5,283,592 | 2/1994 | Bogorad et al. | 343/872 |

OTHER PUBLICATIONS

Patio Sales, Oct. 11, 1960, p. 15 bottom right, Pool Covers.
TVRO Dealer, Jul. 1990, p. 42 ClearSat.

*Primary Examiner*—Donald T. Hajec
*Assistant Examiner*—Tho Phan
*Attorney, Agent, or Firm*—Robert R. Keegan; Head, Johnson & Kachigian

[57] ABSTRACT

There is disclosed a flexible fabric cover for an off-axis parabolic satellite antenna dish having a front surface which serves to cover and protect the front of the antenna dish and the receiver arm; the cover is preferably formed of a generally elliptical sheet of woven synthetic fabric which is at least moderately stretchable, which is about six inches greater in diameter than the antenna dishes it is intended to cover, and which has a central aperture or pocket for the antenna receiver support arm whereby the cover assumes a generally conical, slightly truncated shape; the cover includes securing means in the preferred embodiment consisting of a peripheral hem having threaded therein a drawstring or drawcord such that the cover may be placed over the front of the antenna dish with drawstring relaxed and the drawstring then tightened by employment of a conventional tightening device capturing the rim of the dish with the hem to fasten the cover tightly and smoothly over the dish and the receiver support arm. In one embodiment, the sheet comprises three sections generally in the shape of sectors of an ellipse with an angle of about 45° and one section of generally rectangular shape positionable over the receiver support arm.

20 Claims, 5 Drawing Sheets

SATELLITE DISH UTILITY COVER

This application is a continuation-in-part of patent application Ser. No. 08/241,507 filed May 12, 1994 for SATELLITE ANTENNA DISH COVER now U.S. Pat. No. 5,451,972.

BACKGROUND OF THE INVENTION

1. Field of the Invention.

The present invention relates to covers for satellite communication antennas. Such covers must not interfere with a radio signal being received (or transmitted) in any substantial degree. The antenna cover of the present invention not only allows transmission of radio signals without significant loss, but provides a substantial degree of performance enhancement under certain weather conditions such as heavy precipitation, snow, or ice accumulation.

The present invention in a preferred embodiment comprises a sheet of suitable fabric material of generally circular outline, preferably having a central aperture to accommodate a conventional antenna receiver and feed unit. The cover is provided with means for securing it in place, such as a hem around its periphery which encloses a heavy drawstring or drawcord. The stretchability and flexibility of the materials is such that the cover may be placed over the face of the antenna dish with the antenna feed near the center of the cover and with the periphery of the cover extending beyond the edges of the antenna dish preliminarily to pulling the drawcord tight and causing the drawcord and hem of the cover to capture the edge of the dish to firmly secure the cover; a spool and ratchet, pull-tite or any suitable means may be provided to facilitate the tightening of the drawcord and securing it until one desires to loosen the cord and remove the cover.

The primary use for covers according to the invention is thought to be for home satellite communication receivers of all sizes and shapes, but such covers may also find use for satellite receivers used in commercial or other applications.

The manner of securing the cover on the dish makes it relatively easy to remove the cover for any reason. Decorative covers for the antenna may be designed with seasonal or holiday motifs and changed during the year to appropriately coordinate with the season. Covers according to the invention are suitable for use with existing large antenna dishes from four feet to eleven feet in diameter, and smaller covers are suitable for parabolic antenna dishes of less than two feet diameter as the size is reduced through technological advances.

2. Prior Art

Parabolic antennas have been in use for many decades where they have been employed for uses other than home television reception from communication satellites. In uses for other than home television, a variety of forms of covers have been developed for parabolic antennas, mostly for protection against adverse weather conditions. Such covers have typically been made of rigid plastic material with a spherical or parabolic shape completely enclosing the face of the parabolic antenna including the feed structure located near the focus of the parabola. Examples of such antennas are disclosed in the patent to J. S. Hart, dated Nov. 7, 1967, U.S. Pat. No. 3,351,947, (U.S. Cl. 43/840) and the patent to Grenzeback, dated Jun. 19, 1973, U.S. Pat. No. 3,740,755, (U.S. Cl. 343/840).

Rigid covers have also been employed where the antenna feed structure extends through an opening in the center of the cover as illustrated in the patent to Schudel, dated Feb. 14, 1989, U.S. Pat. No. 4,804,972 (U.S. Cl. 343/840).

Also, covers have been known for parabolic antennas which were formed of a relatively flexible tarpaulin-like sheet preferably of rubberized materials such as "Hypalon". This structure included a pressurizing or pressure equalizing arrangement to prevent wind induced vibrations and damaging of the "radar member of cover" as shown in the patent to W. F. Weir, dated Jun. 11, 1968, U.S. Pat. No. 3,388,401 (U.S. Cl. 343/872). A similar cover in the form of an "Antenna Sunshield Membrane" is shown in the patent to Bogorad, et al., dated Feb. 1, 1994, U.S. Pat. No. 5,283,592 (U.S. Cl. 343/872).

Protective covers for home satellite dishes have been produced and marketed of a sort generally similar to that shown in U.S. Pat. No. Des. 304,454 to Serres, dated Nov. 7, 1989 (U.S. Cl. D14/231). These covers tend to be rather loosely fitting covers which were either flat or extended over some part of the receiver horn support structure; in some cases a drawstring was utilized to secure the cover in a rather loosely fitting fashion.

None of these parabolic antenna covers or other known antenna covers are appropriate to provide a tightly emplaceable and easily removable flexible fabric cover for home television antenna dishes of all sizes and shapes in the manner of the present invention.

SUMMARY OF THE INVENTION

In addition to providing the advantages and features described above, it is an object of the present invention to provide a cover of flexible sheet materials for a satellite communication antenna which has a provision for accommodating a projecting central antenna feed in the form of a central aperture and which comprises an enclosed, peripheral cord so that when the cover is placed on a satellite antenna dish with the edges of the cover overlapping the edges of the dish and the cord is drawn tight and secured, the cover is thereby firmly attached over the face of the antenna dish.

It is another object of the present invention to provide a cover for a satellite antenna dish of flexible fabric material and including means for securing the generally circular cover at its edges to the edge of the antenna dish so that the dish and receiver horn is protected from precipitation and wind blown matter by the cover.

It is still another object of the present invention to provide a decorative cover for a satellite antenna dish formed of moderately stretchable polyester fabric with a peripheral hem through which is threaded a cord having its two ends extended through an opening in the hem and connected to a manually operated tightening and locking mechanism for drawings and maintaining the cord taut to capture the edges of a satellite dish and secure the cover thereon.

BRIEF DESCRIPTION OF THE DRAWINGS

Other objects and advantages of the invention will be apparent from consideration of the following description in conjunction with the appended drawings in which.

DETAILED DESCRIPTION OF THE PREFERRED EMBODIMENTS

Figure 1:
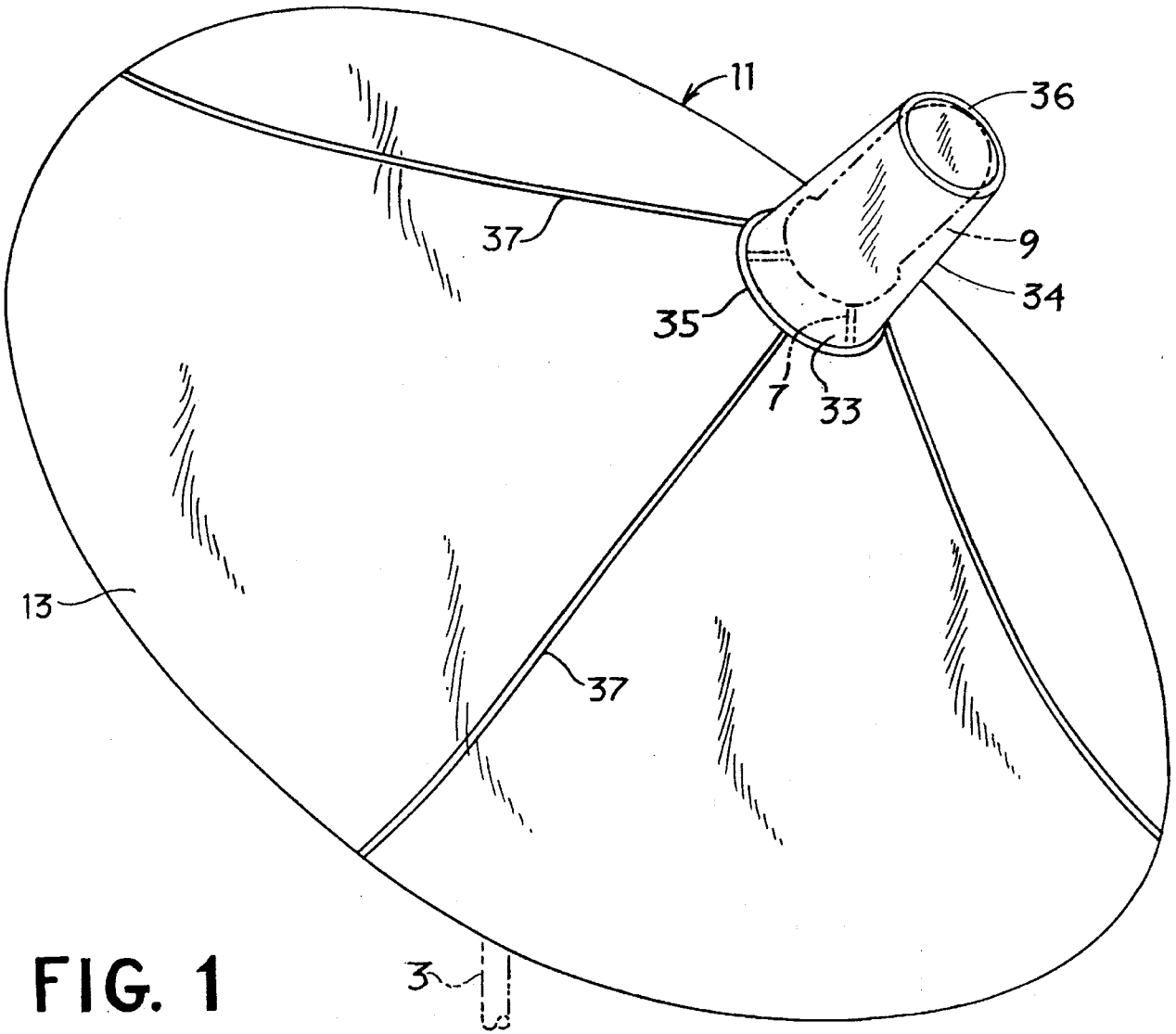
FIG. 1 is a front perspective view of a satellite antenna dish cover according to the invention placed on a satellite antenna dish (shown in phantom lines)

Referring to the drawings, and particularly to FIG. 1, there is shown a cover 11 for a satellite antenna dish as the cover would appear when emplaced on an antenna dish. The components associated with the satellite receiver antenna dish shown (in phantom lines) in FIG. 1 include an upright support member 3, antenna feed support elements 7 and an antenna receiver feed housing 9. It will be understood that the structures of the various antennas with which the satellite antenna cover of the invention may be used form no part of the invention and are shown so that the features and advantages of the satellite antenna cover of the invention may better be explained.

As seen in FIG. 1, the cover 11 is secured on an antenna dish substantially covering the face of the antenna. Visible in FIG. 1 is a central aperture 33 sufficiently large (approximately 12 inch diameter) to pass over the antenna feed housing 9 without dismantling the antenna; the aperture 33 covered with a hood 34 of fabric similar to the fabric of the sheet 13 with a seam 35 securing its lower edges to the cover sheet 13. Hood 34 is generally cylindrical with a circular end panel 36.

Figure 2:
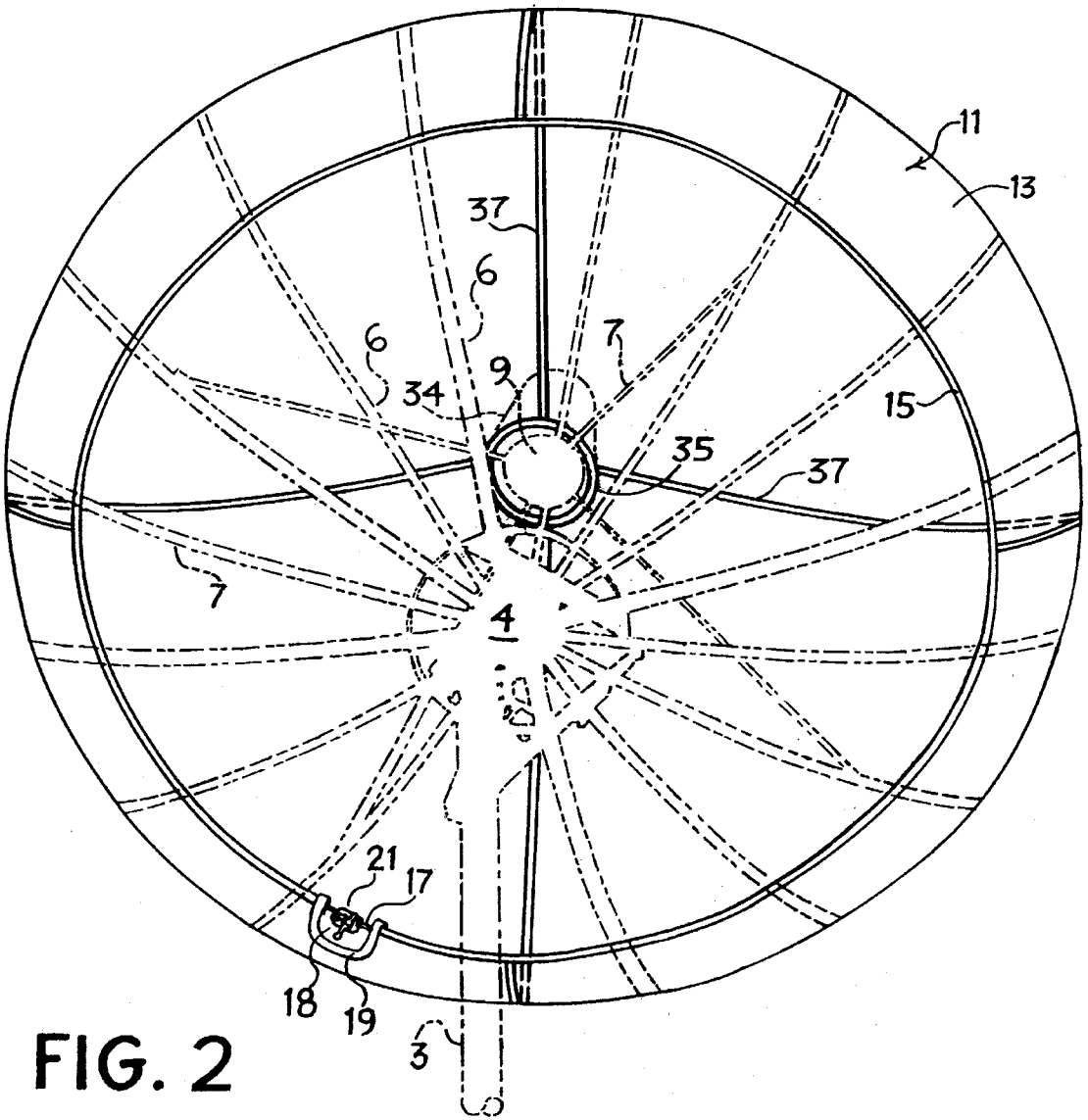
FIG. 2 is a rear perspective view of the satellite antenna cover on the satellite antenna dish (shown in phantom lines) of FIG. 1.
Figure 3:
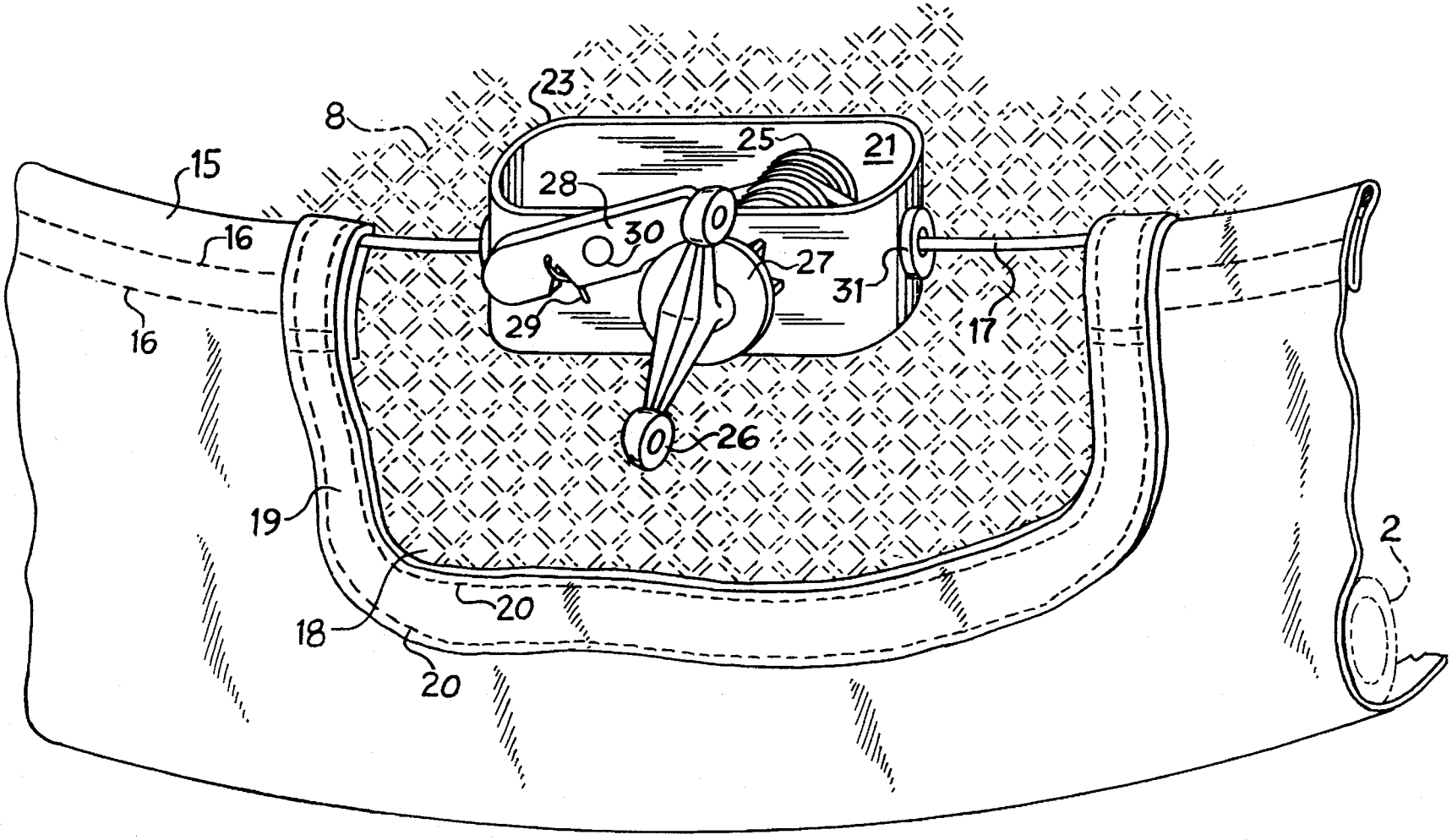
FIG. 3 is an enlarged detailed fragmentary view of the antenna cover of FIGS. 1 and 2 showing the peripheral hem, drawcord and tightening mechanism for securing the cover.

The details of the satellite antenna cover 11 are more clearly shown in FIGS. 2 and 3. The satellite antenna dish and structure illustrated in FIGS. 1, 2, and 3 also includes a circular tubing element 2 together with a plurality of radial ribs 6 which radiate from the center of the satellite antenna structure 4 and, in conjunction with a metal grid 8 or other conductive material secured to and supported by ribs 6, are configured to provide a parabolic radio wave reflector for the antenna.

The structure of the satellite antenna shown in FIGS. 2 and 3 is strictly conventional and does not form a part of the present invention. Although there are substantial variations in the million or more of such antennas in use, they are, with few exceptions, of circular shape in their overall configuration and are formed in a concave dish shape, generally of shallow, parabolic form. Typically, the satellite antenna dish will have an antenna feed element such as antenna feed housing 9 supported centrally and at a short distance in front of the concave surface of the dish either by a single support element or multiple-support elements arranged as a tripod or quadrapod as shown in FIGS. 1, 2, and 3.

It should be noted that the satellite antenna cover 11 according to the invention, when secured on the satellite antenna dish as shown in FIG. 1, assumes a generally conical or pyramidal shape determined by the multiple antenna feed support elements 7. A desirable feature of the cover design, together with the stretchability of the fabric preferably used in its manufacture, makes it possible for the same configuration of satellite antenna cover 11 to be drawn tautly over the antenna dish although there are differences in size and shape of such dishes. It also should be noted that, while the antenna illustrated in FIGS. 1, 2, and 3 is of the type with a metal grid 8 forming the reflective surface, there are satellite antenna dish structures which have a solid dish rather than a grid-like dish and the satellite antenna dish cover of the present invention may also readily be employed with the solid form of parabolic antenna dish which is formed of plastic or similar material.

Figure 4:
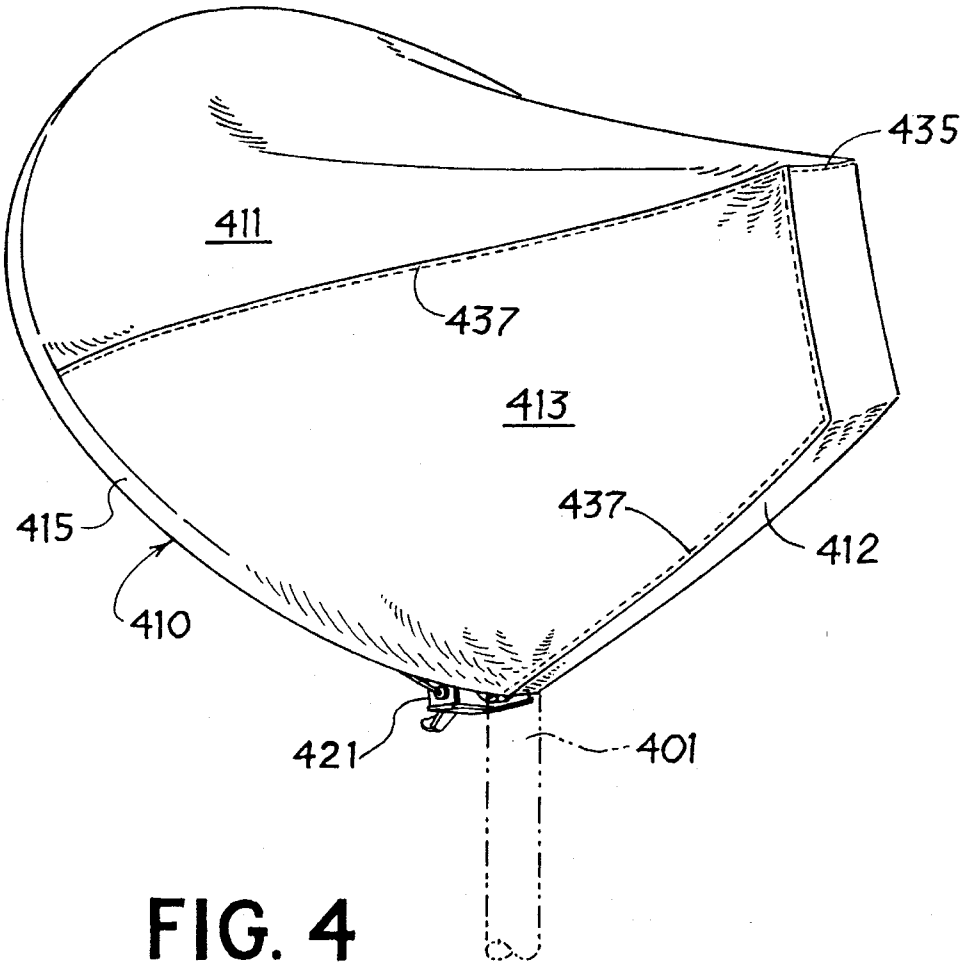
FIG. 4 is a perspective view of an alternative embodiment of the cover preferred for small off-axis parabolic satellite antenna dishes.

The detailed structure of satellite antenna dish cover 11 is shown in FIGS. 1, 2, and 3 where it will be seen that the preferred from is not a single piece of fabric or other sheet material as indicated in FIG. 1, but rather is formed of four pieces approximately in the shape of quadrants of a circle which are joined together along seams 37 which may be made by sewing the fabric together or made by use of adhesive or heat fusing to form seams 37. The fabric of sheet 13 is preferably a polyester fabric of knitted (or woven) form having a thread count of approximately 35 per inch and a weight of approximately four ounces per square yard. Yarn for knitted fabric may be from 40 to 200 denier. Fabric with from 10 to 100 threads per inch and weights of one to ten ounces could be employed, if desired. Preferably the material is at least moderately stretchable, that is, a one foot square piece of the fabric is stretchable by 2% by a force of not more than 10 pounds. When it is desired to form an antenna cover particularly for the antenna with multiple support elements 7 as shown in FIGS. 2, 3, and 4, the angle of each of the four pieces is a few degrees less than 90 degrees to produce an antenna dish cover with a generally conical shape before stretching. Alternatively, the materials could be pieced together to attain the necessary shape in any other fashion including a fewer or greater number of sectors than the four shown in FIG. 2 and FIG. 3.

A decorative pattern may be applied to the fabric by any coating, printing, or dying method, but preferably a sheet transfer printing process is used to impregnate dye into the fabric fibers.

More detailed construction of the antenna cover 11 may be seen in FIG. 3. Antenna cover 11 wraps around circular tubing element 2 of the antenna dish, overlapping the back of the antenna dish by about six inches as shown in FIG. 3. This would be about the expected degree of overlap for a twelve foot diameter cover on an eleven foot diameter dish; there would be greater overlap on small antennas. Hem 15 on the outer edge of cover 11 may be formed by a double row of stitching 16, or an alternative means of securing the two layers of fabric together may be utilized in place of double stitching 16.

A cord 17 is threaded through hem 15 (preferably about one-half to two inches in width) for holding the cover 11 in place. Cord 17 may be formed of nylon or any suitable synthetic or natural fiber and preferably should withstand a tensile force of at least 150 pounds; a synthetic plastic fiber cord of one-eighth to one-quarter inch is suitable for cord 17. Cord 17 may be of stretchable material but such a characteristic is not necessary for cord 17.

A cutout of about six to twelve inches in width in the edge of cover 11 provides an opening 18 which preferably has an edging formed by a binding 19 fastened with double stitching 20. Binding 19 may be of the same or heavier fabric as cover 11 or may be a heavier fabric or plastic sheet material. Opening 18 allows cord 17 to extend from hem 15 in a convenient manner where it is secured to a cord tightening device 21 having a frame 23 and a spool 25 mounted therein to which both ends of cord 17 are connected. Cord tightening device 21 is a conventional, readily available item and is operated to tighten and tension cord 17 by rotation of handle 26 whereby the ends of cord 17 are wrapped on spool 25. The arrangement shown in FIG. 3 has both ends of cord 17 connected at their ends to spool 25, but one could equally well secure only one end of cord 17 to spool 25 and secure the other end of cord 17 to the nonrotating frame 23 of cord tightening device 21. Handle 26 is provided with a ratchet element 27 which is engaged by a pawl 28 pivotally mounted on pin 30; spring 29 urges pawl 28 into engagement with ratchet 27 facilitating the tightening of cord 17 by tightening device 21. Pawl 28 also prevents unintentional unwinding and loosening of cord 17.

Figures 6, 7:
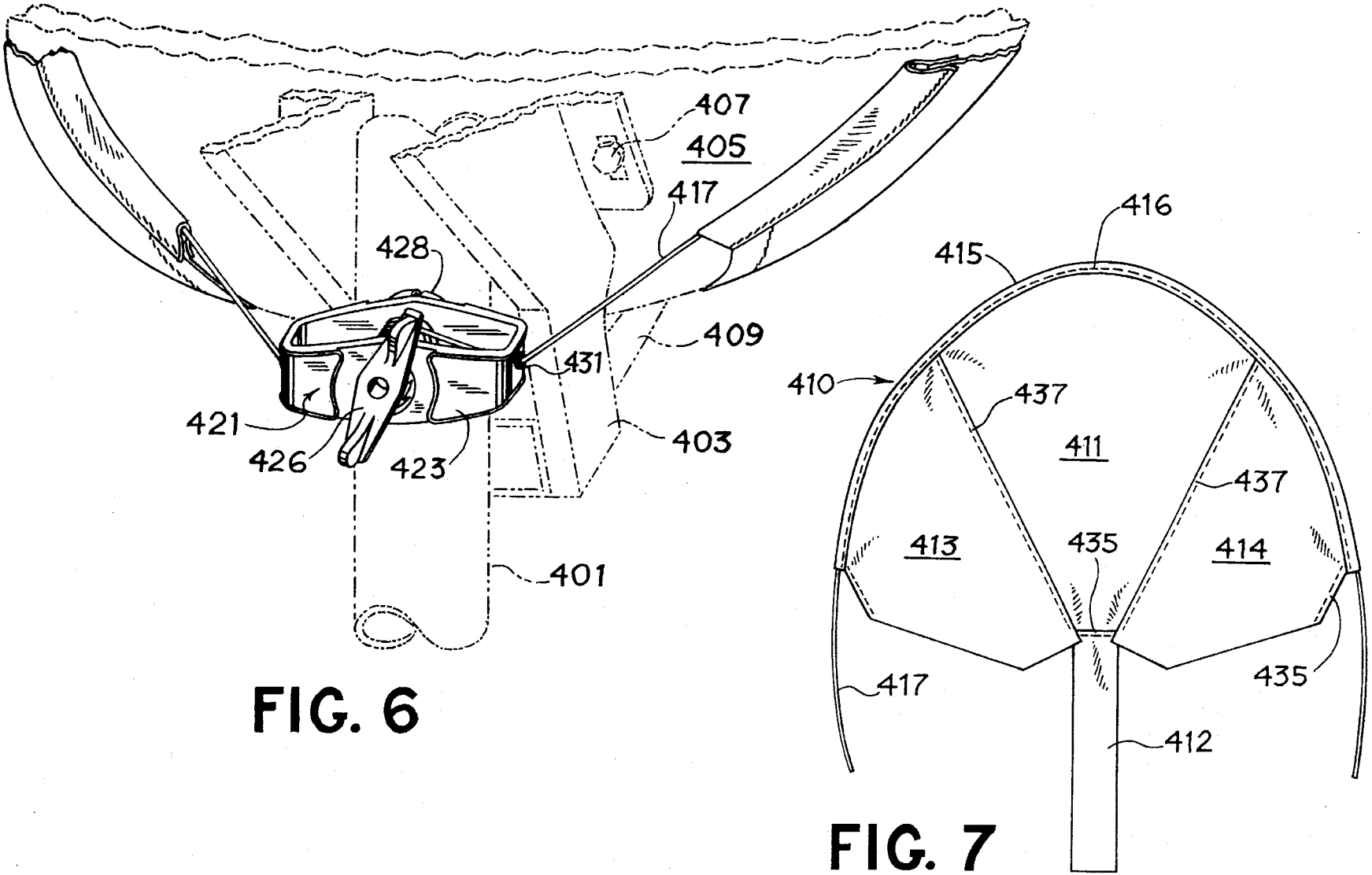
FIG. 6 is an enlarged detail fragmentary view of the antenna cover of FIGS. 4 and 5 showing the peripheral hem, draw cord, and tightening mechanism for securing the cover.
FIG. 7 is a developed plan view showing the cover of FIGS. 4, 5, and 6 laid flat before final stitching into a three-dimensional shape.

Referring now to FIGS. 4, 5, 6, and 7, an alternative form of antenna cover for 10 is shown which is particularly adapted to small off-axis parabolic dish antennas commonly referred to as DSS antennas for DSS digital satellite systems produced by GM Hughes Electronic. To aid in explaining the invention, portions of such an antenna are shown in phantom lines in FIG. 6, for example. Such antennas, due to their small size, may be side mounted on a wall or, in traditional manner, on an upright mast or support. In FIG. 6 the antenna includes an upright support 401, a bracket 403, a parabolic solid dish reflector 405 secured to bracket 403 by bolts 407 or other suitable fasteners, and a receiver horn support arm 409.

Figure 5:
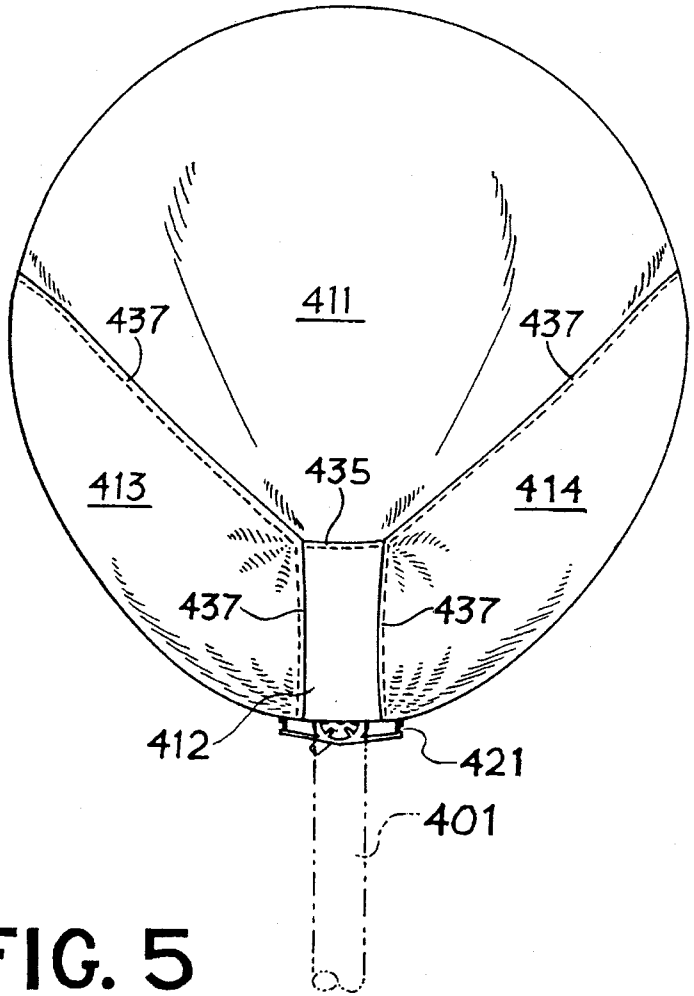
FIG. 5 is a rear elevational view of the antenna cover of FIG. 4.

As best seen in FIG. 7, the antenna cover as shown comprises four fabric sections, 411, 412, 413, and 414. As best shown in FIG. 5, the cover sections 411, 412, 413, and 414 are joined at seams 437 by stitching; they could, of course, be joined by other means, such as adhesive, heat sealing, or the like. When the completely assembled cover 410 is extended or stretched over the parabolic dish 405 and receiver horn arm 409 it assumes the shape shown in FIG. 4 and FIG. 5.

Preferably, the cover 410 is provided with a peripheral hem 415 through which is threaded a draw cord 417 and means for tightening the draw cord 417 such as winch 421 is utilized to tighten the cover to remove the slack and provide a smooth, relatively unwrinkled fit enclosing the antenna dish and receiver horn arm 409.

The tightening device 421 is shown by way of example, and any suitable form of tightening device may be employed. Tightening device 421 is a commercially available product with a plastic body 423, a handle 426, a ratchet member 428, and apertures 431 for guiding the ends of drawcord 417 which ends are captured on the shaft of handle 426.

The DSS satellite dish antenna cover 410 is a utility cover. This cover is designed to protect against signal interference and deterioration of the antenna due to outdoor elements such as son and ice, rain, spring residues, salt water, etc.

The covers 410 and 11 preferably are made from a durable polyester fabric such as water repellant fabric laminated with UV and mold inhibitors. The draw cord 417 preferably is nylon and winch 421 is constructed of plastic.

Cover 410 is designed to cover all parts of the antenna excluding a portion of the back of the antenna dish 405 and the antenna support 401. This is a generally cone shaped cover with its outer edge larger than the dish antenna. Cover 410 encloses the receiver (not shown), the receiver support arm 409 and the face of the dish antenna. Preferably four or fewer patterned pieces are sewn together to make the cover. As shown at 415 the outer edge of the cover 410 is hemmed to accommodate a draw cord 417 for attachment purposes. An opening approximately 2 inches in length for the receiver support arm is left at the center bottom of the cover 410. The draw cord 417 exits the hem 415 toward the middle on both sides of the opening. This allows the cover to fit over the entire antenna front tautly and smoothly and secure behind the receiver support arm 403. When attached, the cover 410 overlaps the back of the antenna dish 405 and the excess is gathered by use of the draw cord 417. The draw cord 417 is secured by use of a tightening device such as winch 421.

In accordance with the invention, a solid color or a decorator design may be applied to the relatively light weight fabric of cover 410 which may be treated to make it weather and mildew resistant and UV radiation resistant. The fabric of cover 410 is preferably a polyester fabric of knitted (or woven) form having a thread count of approximately 35 per inch and a weight of approximately four ounces per square yard. Yarn for knitted fabric may be from 40 to 200 denier. Fabric with from 10 to 100 threads per inch and weights of one to ten ounces could be employed, if desired. Preferably the material is at least moderately stretchable, that is, a one foot square piece of the fabric is stretchable by 2% by a force of not more than 10 pounds.

Installation is done by placing the decorative cover on the satellite dish and the central or offset receiving device. On the back side of the satellite dish, the overlapping cover will be pulled tightly with the use of a strong, lightweight cord drawstring. The two ends of the drawstring will be captured in an opening provided in the spool of the tightening device or otherwise secured to the spool. Rotating the winding handle and the spool of the tightening devices puts substantial tension on the cord preventing the cover from being displaced from the antenna dish. The ratchet and locking mechanism for the spool of the tightening device thus secures the drawstring and cover 410 or 11 to the dish antenna.

The satellite antenna dish cover will produce a slightly cone shaped or substantially cone shaped cover depending on the structure of the satellite for which it is designed. If it is a satellite antenna with three or four braces attached at the side of the antenna dish angling to the center to support the receiving device, the cover will be slightly cone shaped. If it is an off-axis parabolic DSS antenna it will have the generally frustro-conical shape shown in FIGS. 4 and 5. The arcs defined by the arcuate edges of sections 411, 413, and 414, either in three-dimensions or in two dimensions, tend toward an elliptical shape (circular is a special case of elliptical). In either case the stretchability of the fabric will cause the cover to assume a smooth, wrinkle-free surface.

FIG. 7 shows the manner in which a cover 410 according to the invention may be formed of four pieces of fabric and the reference numbers in FIG. 7 correspond to those of FIG. 4 and FIG. 5 where applicable. The fabric of which antenna cover 410 is formed is at least slightly stretchable as previously described and also is preferably opaque. Although transparent material could be used for the antenna cover, the opaque material overcomes any tendency of the antenna dish to focus sunlight on the antenna receiver which can be very detrimental. The illustration in FIG. 7 is generally accurate but it is not precisely to scale. Furthermore, the shape of the sections 411, 413, and 414 individually could be altered in many ways while keeping the overall configuration of the cover substantially as shown and described above. As previously mentioned, the sections 411, 413, and 414 could be replaced by a greater number or lesser number of sections which would provide the same shape. In fact, sections 411, 413 and 414 could be replaced by one single piece of fabric having a shape substantially as that shown in FIG. 7. It is preferred, however, that at least section 412 is a separate piece sewn or otherwise secured into the cover. While section 412 could theoretically be included as part of a single unitary cover piece, there appears to be no advantage in doing so. In the preferred form of cover shown in FIGS. 4–7, the angles subtended by the long straight sides of sections 411, 413, and 414 are each approximately 45 degrees. Due to the fact that the angles are truncated by different amounts and do not have coincident apices the total angle of the composite piece formed by sections 411, 413, and 414 tends to be somewhat greater than 135 degrees. In any event, the angles and dimensions of the sections from which the antenna cover is made are determined by and constrained by the requirement that the antenna cover fit a particular antenna dish and receiver support arm snugly, smoothly, and tightly.

An advantage accruing from the four section configuration shown in FIG. 7 is that the sections 411, 413, and 414 may be cut with 45 degree angles which, added together, are a right angle which aids laying out the sections on a large fabric piece to minimize waste.

While the specific forms of satellite antenna dish covers shown and described are the best currently known form of cover for carrying out the purpose of the invention, such purpose can be carried out by substantially different forms of covers. For example, the relatively large hooded aperture in the cover 11 could be altered to be open or partially reclosable or of different shape; or other alterations could be made in cover 410 to accommodate other forms of antenna feed and receiver support structures. Clearly, the particular form of spool-type cord tightening devices illustrated and described could be replaced by any one of numerous forms of such devices, such as ball-locking pull-tires. Woven synthetic fabric is the preferred cover material, but knitted fabric or solid or perforated plastic sheet may be employed.

While the hem and drawcord form of attachment of the cover has numerous advantages, including accommodation of antennas of different sizes, the primary advantage of the antenna cover 410 could be achieved in part for one size of antenna by the use of u-clips riveted or otherwise secured to the edge of the cover in sufficient number to maintain the cover in place when the clips were snapped over the edge of the antenna dish.

In addition to the variations and modifications to the satellite antenna covers of the invention which have been shown, described or suggested, other variations and modifications will be apparent to those skilled in the art and, accordingly, the scope of the invention is not to be considered limited to the embodiments and variations thereof which have been described or suggested, but is rather to be determined by reference to the appended claims.

What is claimed is:

1. A weather protection cover for a parabolic reflector satellite antenna with an off-axis receiver support arm and a generally elliptical outline reflector dish comprising:

at least three sections of stretchable synthetic fabric, at least two of which are shaped generally with an outline of a sector of an ellipse with an arcuate edge and two substantially straight line edges subtending an acute angle, said at least three sections being formed into a three-dimensional surface joined along substantially straight line edges with said arcuate edge forming a generally continuous oval through at least 270° while the substantially straight line edges tend to assume the positions of elements of a truncated cone; and means for fastening said arcuate edges around the periphery of the reflector dish with a receiver horn within and imparting tension to said fabric to remove wrinkles and form a generally smooth, tight surface.

2. A cover as recited in claim 1 wherein said at least three sections comprise four sections of stretchable synthetic fabric, three of which are shaped generally with an outline of a sector of an ellipse with an arcuate edge and two substantially straight line edges subtending an angle of approximately 45°, an apex of the angle being truncated.

3. A cover as recited in claim 1 wherein said fabric is woven.

4. A cover as recited in claim 2 wherein one of said sections is substantially in the shape of an elongated rectangle.

5. A cover as recited in claim 4 wherein the shape of said rectangle generally conforms to the longitudinal cross-section of said support arm.

6. A cover as recited in claim 2 wherein said fabric is woven.

7. A cover as recited in claim 4 wherein said fabric is woven.

8. A weather protection cover for a parabolic reflector satellite antenna with a receiver support arm and a generally elliptical outline reflector dish comprising:

at least two sections of synthetic fabric, at least one of which is shaped generally with an outline of a sector of an ellipse with an arcuate edge and two substantially straight line edges subtending an angle less than 180°, said at least two sections being formed into a three-dimensional surface joined along substantially straight line edges with said arcuate edge forming a generally continuous oval through at least 270° while the substantially straight line edges tend to assume the approximate position of an element of a truncated cone; and means for fastening said arcuate edge around the periphery of the reflector dish with a receiver horn within and for imparting tension to said fabric to remove wrinkles and form a generally smooth, tight surface.

9. A cover as recited in claim 8 wherein said at least two sections comprise four sections of stretchable synthetic fabric, three of which are shaped generally with an outline of a sector of an ellipse with an arcuate edge and two substantially straight line edges subtending an angle of approximately 45°, the apex of the angle being truncated.

10. A cover as recited in claim 8 wherein said synthetic fabric is woven stretchable synthetic fabric.

11. A cover as recited in claim 9 wherein one of said sections is substantially in the shape of an elongated rectangle.

12. A cover as recited in claim 11 wherein the shape of said rectangle generally conforms to the longitudinal cross-section of said support arm.

13. A cover as recited in claim 9 wherein said fabric is woven.

14. A cover as recited in claim 11 wherein said fabric is woven.

15. A cover as recited in claim 8 wherein one of said sections is substantially in the shape of an elongated rectangle.

16. A cover as recited in claim 15 wherein the shape of said rectangle generally conforms to the longitudinal cross-section of said support arm.

17. A weather protection cover for a parabolic reflector satellite antenna with an off-axis arm on which is mounted a receiver horn and a generally elliptical outline reflector dish comprising:

a cover sheet with a generally elliptical outline larger than that of said reflector dish formed of stretchable synthetic fabric and having an interruption in said outline to accept said off-axis arm;

said sheet having a folded hem portion around the periphery thereof for enclosing a drawcord;

a drawcord threaded through said hem portion and having ends extending from said interruption; and a tightening device engageable to said ends of said drawcord;

whereby said cover, when said drawcord is relaxed, may be placed over said reflector dish, after which said drawcord may be tightened by employment of said tightening device to capture the rim of said dish with the drawcord in the hem of said cover to fasten said cover securely and tightly over said dish to substantially enclose the dish behind the cover sheet.

18. A cover as recited in claim 17 wherein said fabric is woven.

19. A cover as recited in claim 17 wherein said cover sheet is formed of at least three sections at least two of which are shaped generally with an outline of a sector of an ellipse.

20. A cover as recited in claim 17 wherein said cover sheet has an outline the periphery of which is in the shape of a portion of an ellipse.

* * * * *